US005682741A

United States Patent [19]

Augustin et al.

[11] Patent Number: 5,682,741

[45] Date of Patent: Nov. 4, 1997

[54] EXHAUST MANIFOLD FOR AN INTERNAL COMBUSTION ENGINE

[75] Inventors: Helmut Augustin, Hamburg; Henning Blöcker, Stelle; Pierre Bonny; Wolfgang Jekel, both of Hamburg; Hans-Jörg Kaifel, Schomdorf; Berndt Schütz, Stuttgart, all of Germany

[73] Assignee: Mercedes-Benz AG, Stuttgart, Germany

[21] Appl. No.: 622,835

[22] Filed: Mar. 27, 1996

[30] Foreign Application Priority Data

Mar. 29, 1995 [DE] Germany ..... 195 11 514.7

[51] Int. Cl.[6] ..... F01N 7/10; F01N 7/18

[52] U.S. Cl. ..... 60/323; 60/272; 60/322; 285/150

[58] Field of Search ..... 60/323, 272; 285/138, 285/150

[56] References Cited

U.S. PATENT DOCUMENTS

| | | | |
|---|---|---|---|
| 1,271,779 | 7/1918 | Schroeder et al. | 285/150 |
| 3,729,937 | 5/1973 | Haddad | 60/298 |
| 3,990,856 | 11/1976 | Suzuki | 23/277 |
| 4,386,586 | 6/1983 | Santiago et al. | 123/52 |
| 5,349,817 | 9/1994 | Bekkering | 60/322 |
| 5,419,127 | 5/1995 | Moore, III | 60/322 |
| 5,572,868 | 11/1996 | Okamoto et al. | 60/323 |

FOREIGN PATENT DOCUMENTS

| | | |
|---|---|---|
| 0 582 985 A1 | 2/1994 | European Pat. Off. . |
| 2 164 263 | 7/1973 | France . |
| 2 549 529 | 1/1985 | France . |
| GM 79 25 201 | 12/1979 | Germany . |
| GM 80 04 882 | 6/1980 | Germany . |
| 32 16 980 | 11/1983 | Germany . |
| 41 27 634 | 2/1993 | Germany . |
| 2 058 918 | 4/1981 | United Kingdom . |

*Primary Examiner*—Ira S. Lazarus
*Assistant Examiner*—Ljiljana V. Ciric
*Attorney, Agent, or Firm*—Klaus J. Bach

[57] ABSTRACT

An exhaust manifold for an internal combustion engine includes an inner duct with flanges for connection to an engine. The inner duct is enclosed by an envelope consisting of two shells which are interconnected at their edges by seams. Between the inlet flanges, the seams are disposed at a substantially greater distance from the inner duct than in other areas such that, in a cross-sectional plane disposed between, and extending normal to, the flanges, the envelope has drop-like shape.

8 Claims, 3 Drawing Sheets

EXHAUST MANIFOLD FOR AN INTERNAL COMBUSTION ENGINE

BACKGROUND OF THE INVENTION

The invention relate to an exhaust manifold for an internal combustion engine comprising an inner exhaust gas duct structure and an outer enclosure envelope the inner exhaust gas duct structure at a distance therefrom.

EP 0 582 985 A1 discloses an exhaust gas manifold for receiving the exhaust gases from an internal combustion engine which includes a multi-port composite inner duct and an enclosure surrounding the inner duct with a distance and which has flange means for connecting the inner duct to several spaced exhaust channels of the internal combustion engine. Furthermore, the inner duct has a discharge flange for the connection of an exhaust pipe. The enclosure consists of enclosure parts which are interconnected at their edges and which surrounds the inner duct at the ends where the inner duct extends into the flange means. In this manner, a space is formed between the inner duct and the enclosure which provides for air gap insulation or which may be filled with an insulating material.

In the arrangement known, the flange means for all the connection of the inner duct to the cylinder head are in the form of a continuous flange plate which is a so-called combination flange which, in relation to the substantially thinner walls of the inner duct and the enclosure, is non-elastic and of stable shape. As a result, the connections between the various sections of the inner duct need to be engaged in a slidable manner so that the expansion movement caused by temperature changes can be accommodated. To seal such slide connections, sealing elements are provided which prevent the escape of exhaust gases from the inner duct into the space between the inner duct and the enclosure. Such an arrangement is complicated in its structure, expensive to manufacture and, because of the combination flange, relatively heavy.

DE-GM 80 04 882 discloses an exhaust gas manifold with four single flanges arranged in a row wherein the two center flanges are connected to a first inner duct and the two outer flanges are connected to a second inner duct. Each of these inner ducts is disposed in an enclosure which consists of enclosure parts which are joined at their edges and which surround the inner duct adjacent the flanges. Between the inner duct and the enclosure, there is a space providing for air gap insulation. Although this arrangement provides for single flanges, it requires the use of two separate ducts with separate enclosures so that this exhaust gas manifold is relatively complicated in design and, because of the relatively long seams between the enclosure parts, relatively expensive to manufacture.

It is the object of the present invention to provide an exhaust gas manifold with an inner exhaust gas duct structure and an outer enclosure surrounding the inner exhaust gas duct structure in spaced relationship which is simple in design, which is relatively light and which achieves a long life span.

SUMMARY OF THE INVENTION

In an exhaust manifold for an internal combustion engine which includes an inner duct having at least two spaced exhaust gas inlets and an exhaust gas outlet, each provided with a flange for connection to an engine and an exhaust pipe respectively, the inner duct is enclosed by an envelope consisting of two shells which are interconnected at their edges by seams and closely surround the inner duct adjacent the flanges but are otherwise spaced from the inner duct to form an insulating air space and the seam extending between said inlet flanges is disposed at a substantially greater distance from the inner duct than the seam in other areas such that, in a cross-sectional plane disposed between, and extending normal to, said flanges, said envelope has a drop-like shape.

The advantages of the exhaust gas manifold according to the invention are not only relatively small weight and low manufacturing costs but also long life, particularly of the enclosure. This is achieved by the shape of the enclosure which has no curvatures with small radii and by the form of the joints between the flanges which both result in substantially lower tensions than in the prior art arrangements.

In a preferred embodiment of the invention, the enclosure seam between the flanges has a straight section with curved sections at the sides whose ends are connected to the inner duct. With such an arrangement, the forces generated as a result of heat expansion are effective almost exclusively in the longitudinal direction of the plane of the flanges so that they are not subjected to essential bending forces during temperature changes. Alternatively, the exhaust gas manifold may be so shaped that the arc of the seam between the enclosure parts comprises an intermediate section and adjacent side sections wherein the radius of curvature of the intermediate section is greater than the radius of curvature of the side sections. The radius of curvature of the intermediate section may be about five times as large as the radius of curvature of the adjacent side sections. But it is also possible to provide a seam with a curved section which has a uniform curvature, In this case, the radius of curvature of the curved section should preferably be about 0.6 times the distance between the ends of the curved section. Such an arrangement avoids that sections of the seams extend transversely to the plane of the flanges so that bending stresses of the enclosure are minimal.

Suitably, the enclosure is formed by two half shells which have several seams with the seams extending between the inlet flanges being disposed at a greater distance from the inner inlet than the other seams. This provides for an enclosure structure which, in the areas adjacent the duct flanges, provides for an increased distance between the inner duct and the enclosure walls. Preferably, the enclosure has, in a cross-sectional plane extending between the duct flanges and normal to the flanges, about the shape of a drop.

In order to interconnect the two half shells forming the enclosure, different types of seams can be used. Particularly advantageous are embodiments with overlap type seams or double flanged seams. It may be advantageous to provide different types of seams for different areas of the enclosure. Suitably, the seams extending between the cylinder head flanges are overlap-type seams and the other seams are double flanged seams. The double flanged seams have preferably 1 mm wide flanges for engagement with each other. A greater width is possible but not necessary. It is also possible that the flange of one of the half shells is wider than those of the other half shell and the excess width of the wider flange is preferably 1 mm to 1.5 mm.

Such an arrangement is especially advantageous for particular connecting processes such as laser welding. The fish plate type seam is formed by overlapping edges with overlap areas of a width of about 4 mm. All seams of the enclosure are welded together. In order to insure that the air gap between the inner duct and the outer enclosure exceeds a predetermined distance, at least one spacing means is provided between the inner duct and the enclosure which is preferably a spacing ring consisting of a material which when heated burns without leaving a residue.

Several embodiments of the invention are described below on the basis of the accompanying drawings.

DESCRIPTION OF THE PREFERRED EMBODIMENTS

Figure 1:
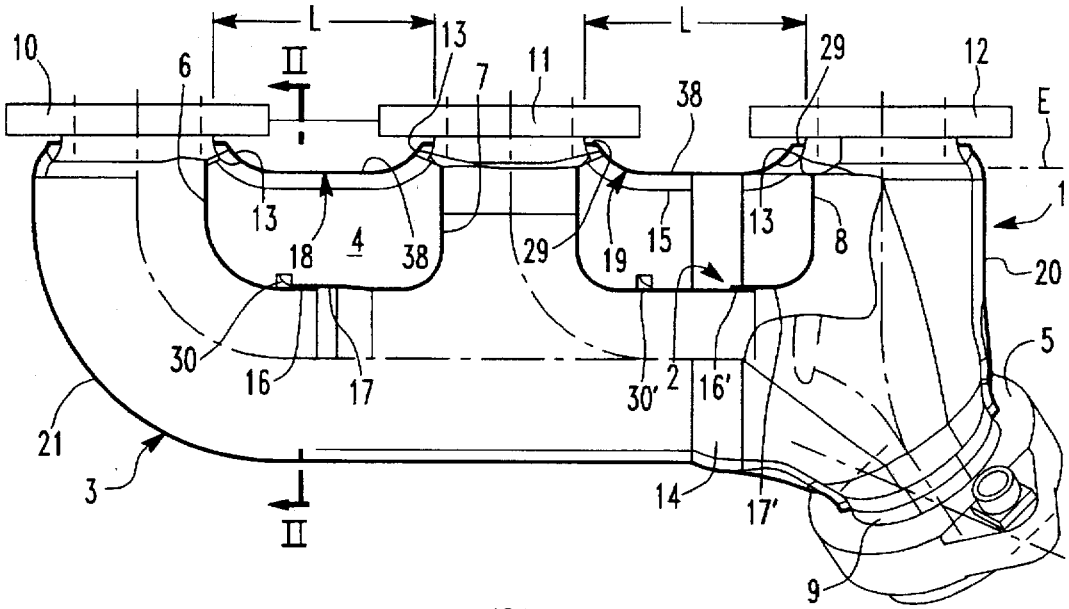
FIG. 1 is a top view of an air gap insulated exhaust gas manifold shown partially in section.

FIG. 1 is a top view of an exhaust gas manifold 1 consisting essentially of an inner duct 2 receiving the exhaust gas, an enclosure 3, several inlet flanges 10, 11, 12 and an outlet flange 5. The inner duct 2 comprises a curved section 6, a T-shaped center section 7 and a Y-shaped connecting section 8, with each of the sections 6, 7, 8 being connected to one of the inlet flanges 10, 11, 12 and the connecting section 8 being provided with a connecting piece 9 carrying the outlet flange 5 in a sliding fit-like manner. The curved section 6 has, at its end remote from the inlet flange 10, a connecting portion 16 which is inserted into a socket portion 17 of the center section 7 and is received therein possibly with a little play between the adjacent walls of the inner duct 2. Further, the center section 7 is connected to the connecting section 8 by a connecting portion 16' on the center section 7 and a socket portion on the connecting section 8.

The enclosure 3 consists of a first half shell 14 and a second half shell 15 with edges which are disposed adjacent one another along the seams 18, 19 20, and 21 and which are welded together. The first seam 18 extends between the inlet flanges 10 and 11, the second seam 19 extends between the inlet flanges 11 and 12, the third seam 20 follows the shape of the connecting section 8 between the inlet flange 12 and the outlet flange 5 but is disposed at a distance from the wall of the connecting section 8 and the fourth seam 21 extends from the inlet flange 10 to the outlet flange 5 along the the inner duct 2 but in spaced relationship therefrom. As can be seen from FIG. 1, the first and second seams 18, 19 are disposed essentially in a plane E adjacent the plane of the inlet flange surfaces. Along stretches 38, the seams 18 and 19 extend essentially along a straight line. Toward the inlet flanges 10, 11, 12, the seams are slightly curved along an arc 13 with a relatively large radius. At the free ends 29 of the arcs 13, the connections with the sections 6, 7, 8 of the inner tube 2 are established. The distance between the free ends is indicated by L.

In this manner, the enclosure 3 provides a casing wherein the distance between the enclosure 3 and the inner duct 2 is substantially larger in the area of the seams 18, 19 than it is in the area of the seams 20, 21. The sections 6, 7, 8 forming the inner duct 2 are received in the openings of the inlet flanges 10, 11, 12 and, respectively, the outlet flange 5. The edges of the enclosure 3 can be welded into the openings of the flanges or they can be welded to the inner duct just ahead of the inlet flanges. In this manner, a closed space 4 is formed around the inner duct 2 which provides for air gap insulation.

Disposed around the inner duct 2 at axially spaced locations are two rings 30, 30' which consist of a material which disintegrates if heated sufficiently. For this purpose, the material may be polyethylene which burns without residues and is non-polluting. These rings 30, 30' serve as a means for maintaining a distance between the inner duct 2 and the envelope 3 insuring the formation of a minimum air gap between the inner duct 2 and the envelope 3.

Figure 2:
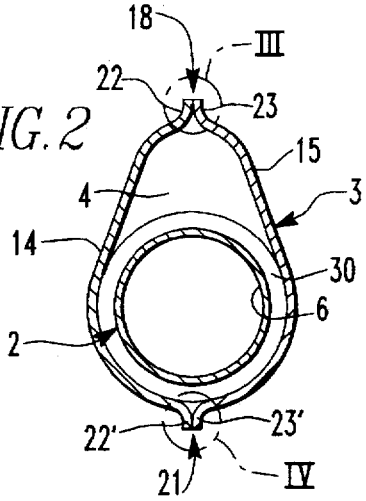
FIG. 2 is a cross-sectional view along line II—II of FIG. 1.

FIG. 2 is a cross-sectional view taken along line II—II of FIG. 1 wherein, for reasons of clarity, the inlet flange 10 and the end of the curved section 6 are not shown. It can be seen from FIG. 2 that the first half shell 14 and the second half shell 15 have outwardly bent edges 22, 22' and 23, 23' where the half shells 14 and 15 are engaged with one another in a mirror-image fashion. The edges 22, 23 and 22', 23' are welded together. Because of the shape of the edges, the resulting seams 18, 21 are flanged seams. The cross-section of the enclosure 3 has the shape essentially of a drop as the first seam 18 extends at a much greater distance from the curved section 6 than the fourth seam 21. The angle over which the enclosure 3 is disposed at a uniform distance from the tube section 6 is about 230° (see FIG. 2).

Figure 3:
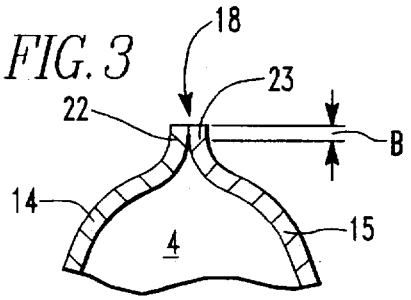
FIG. 3 is an enlarged representation of the area indicated by circle III of FIG. 2.
Figure 4:
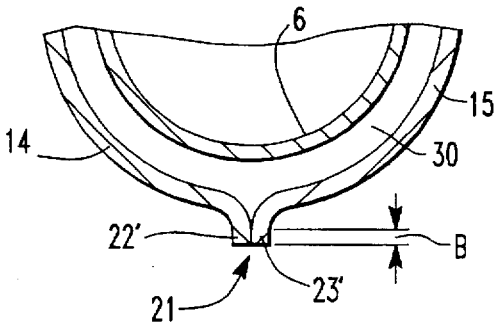
FIG. 4 is an enlarged representation of the area indicated by the circle IV of FIG. 2.

FIGS. 3 and 4 are enlarged representations showing the areas of connection between the half shells 14 and 15. They show more clearly the contour of edges 22, 23 and 22', 23' respectively, and the shape of the flange seam. It can be seen that the width B of the edge flanges needs to be only relatively small, that is a width B of about 1 mm is considered to be sufficient, but it can be greater if this is considered to be advantageous with regard to design conditions. Alternatively, the edge of one of the half shells may be wider than that of the other half shell with the excess width being preferably 1 mm to 1.5 mm. Such an arrangement is particularly advantageous for the interconnection of the half shells by laser welding.

Figure 5:
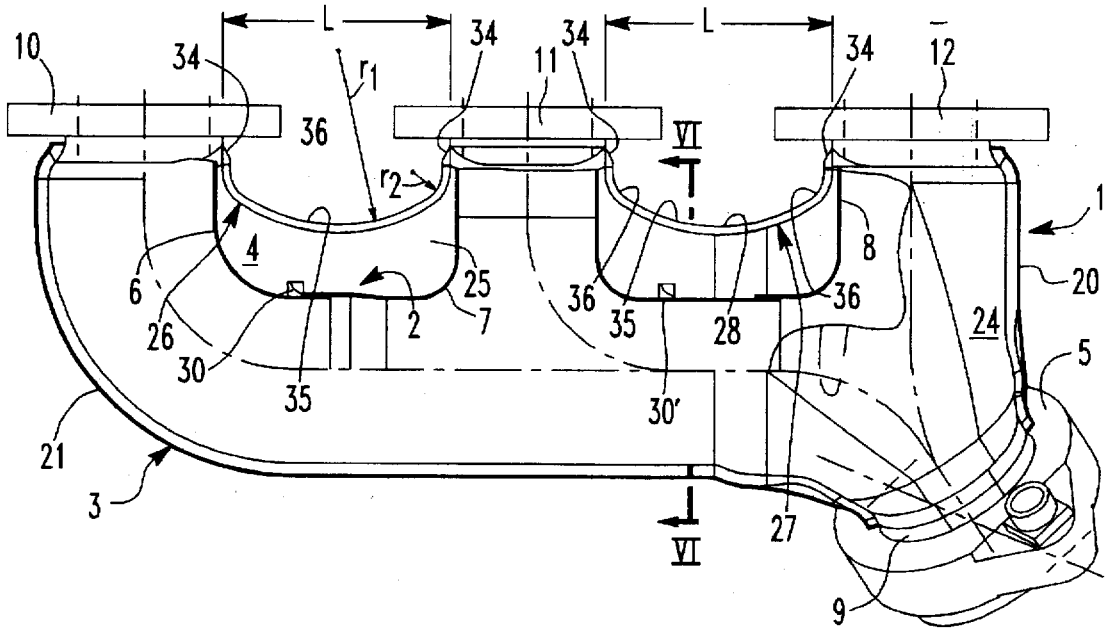
FIG. 5 is a view like that of FIG. 1 showing another embodiment of the invention.

The arrangement shown in FIG. 5 represents a variation of the arrangement shown in FIG. 1 wherein the enclosure 3 consists of two half shells 24 and 25 with a first seam 26 extending along arcs 28 of different curvature. The shape of the arc is given by an intermediate section 35 with a relatively large radius $r_1$ of curvature and adjacent sections 36 with somewhat smaller radii $r_2$ of curvature. The radius $r_1$ of the intermediate section 35 is preferably about five times the radius $r_2$ of the adjacent sections 36. The free ends 34 of the sections 36 end in welding seams at the ends of the curved sections 6, of the center section 7 and of the connecting section 8 which are inserted into the openings in the inlet flanges 10, 11, 12. The ends 34 of the arc 28 are consequently also disposed at a distance L from one another. With this arrangement, the distances of the seams 26 and 27 from the inner duct 2 are not as large as they are in the embodiment of FIG. 1 but they are still substantially larger than the distance between the seam 21 and the inner duct 2 as clearly seen in FIG. 6. Otherwise, the embodiment as shown in FIG. 5 is the same as that of FIG. 1. Consequently, the same reference numerals are used for the same parts.

Figure 6:
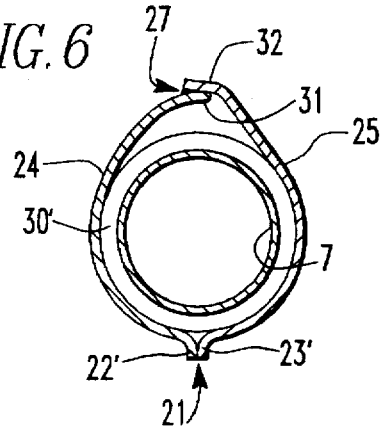
FIG. 6 is a cross-sectional view taken along line VI—VI of FIG. 5, FIG. 7 show another embodiment for the arrangement of FIG. 6.

FIG. 6 is a cross-sectional view taken along line VI—VI of FIG. 5. Again, the inlet flange 10 and the adjacent end of the curved section 6 of the inner tube are not shown. It is apparent from FIG. 6 that the second seam 27 is formed as an overlap type seam wherein an edge 31 of the first half shell is overlaid, and engaged, by an edge 32 of the second half shell 25. The fourth seam 21 corresponds, as to its shape, the flanged seam as shown in, and described with regard to, FIG. 2. Again, spacer rings 30, 30' are disposed between the inner duct 2 and the enclosure 3.

Figure 7:
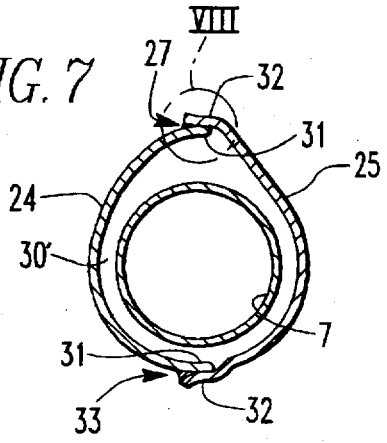
Figure 8:
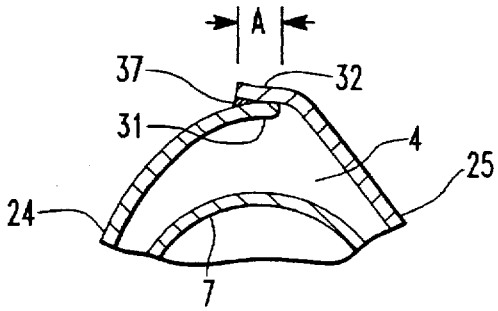
FIG. 8 is an enlarged representation of the area indicated by the circle VIII of FIG. 7.

FIG. 7 shows a variation for the arrangement of FIG. 6, wherein also the fourth seam 33 opposite the second seam 27 is an overlap seam so that the edges of the half shells 24 and 25 overlap like the edges of a shoebox. FIG. 8 shows the portion of FIG. 7 encircled by VIII in greater detail. It is apparent therefrom that the overlapping edges 31, 32 of the half shells are interconnected by a weld seam 37 whereby an overlap area A is formed which has a width of preferably about 4 mm.

Figure 9:
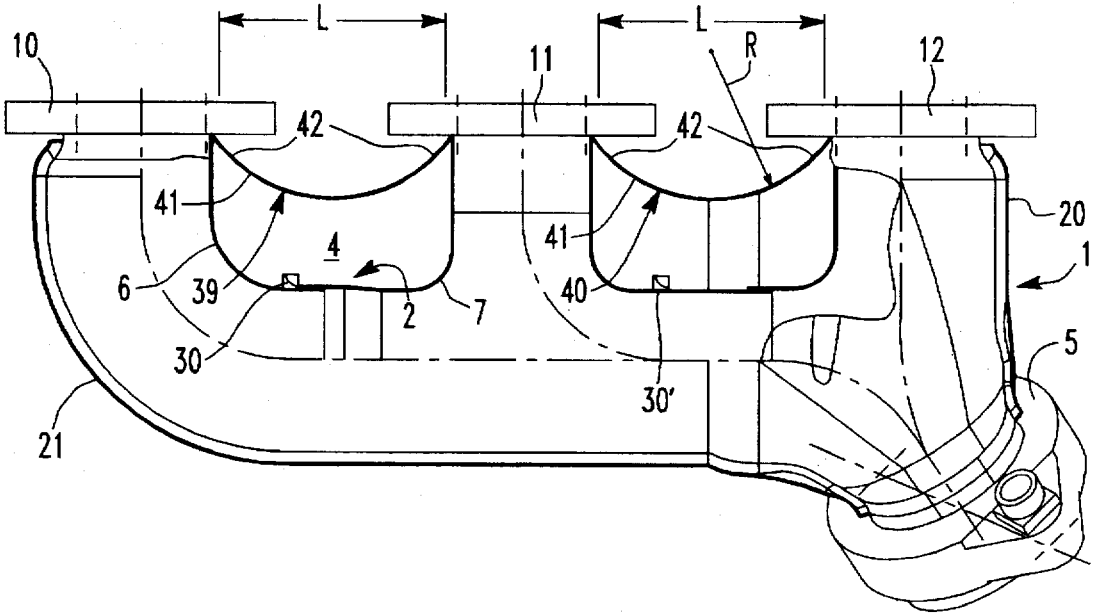
FIG. 9 is a view like that of FIG. 1 showing yet another embodiment of the invention.

FIG. 9 shows another variation of the embodiment as shown in FIG. 1 wherein the contours of the first and second seams 39 and 40 follow an arc 41 with uniform curvature. The ends 42 of the seams 39, 40 are connected to the inner duct 2. The radius R of the arc 41 is at least half the distance between the ends of the arc, as shown, and preferably about 0.6 times the distance L between the ends 42 of the seams 39, 40 or the arc 41.

Otherwise, the arrangement is the same as that shown in FIG. 5 and the same reference numerals are used for the same parts.

What is claimed is:

1. An exhaust manifold for an internal combustion engine comprising: an inner duct having at least two inlets and one outlet with all of the inner duct inlets being parallel to each other, a separate inlet flange connected to each inlet for mounting said manifold to an engine to receive engine exhaust gases, an outlet flange connected to said outlet for the mounting of an exhaust pipe and an envelope enclosing said inner duct between said inlet and outlet flanges, said envelope comprising two half shells having circumferential edges which are interconnected by a seam and which closely surround said inner duct adjacent said inlet and outlet flanges, but are otherwise spaced from said inner duct so as to provide for an insulating air space between said inner duct and said enclosure, said seam being disposed in the area between said inlets at a substantially greater distance from said inner duct than in any other area such that, in all cross-sectional planes disposed between, and extending normal to, said inlet flanges, said envelope has a drop-like shape.

2. An exhaust manifold for an internal combustion engine according to claim 1, wherein said seam extending between said inlet flanges has a contour including an essentially straight section disposed in a plane extending in a close parallel relationship to said inlet flanges.

3. An exhaust manifold for an internal combustion engine according to claim 1, wherein said seam has, in the area between said inlet flanges, a contour in the shape of an arc which, at least partly, has a radius of curvature that is at least half the distance between the ends of the arc.

4. An exhaust manifold for an internal combustion engine according to claim 2, wherein said essentially straight section of said arc is joined, at its opposite ends by arc sections having ends connected to said inner duct.

5. An exhaust manifold for an internal combustion engine according to claim 3, wherein said seam includes, between said inlet flanges, an intermediate section and, at opposite ends thereof, curved end sections, the radius of curvature of said intermediate section being larger than the radius of curvature of said end sections.

6. An exhaust manifold for an internal combustion engine according to claim 5, wherein the radius of curvature of said intermediate section is about five times the radius of curvature of said end sections.

7. An exhaust manifold for an internal combustion engine according to claim 3, wherein, between said inlet flanges, said seam has a uniform curvature between its opposite ends.

8. An exhaust manifold for an internal combustion engine according to claim 7, wherein the radius of curvature of said seam between said inlet flanges is about 0.6 times the distance between the opposite ends of said seam.

* * * * *